US005411454A

United States Patent [19]

Chang

[11] Patent Number: 5,411,454

[45] Date of Patent: May 2, 1995

[54] PEDAL FOR SPORTING EQUIPMENT

[76] Inventor: John Chang, No. 1-2, Lane 975, Chun-Jih Road, Tao-Yuan City, Taiwan, Prov. of China

[21] Appl. No.: 280,446

[22] Filed: Jul. 26, 1994

[51] Int. Cl.[6] ..... A63B 21/00

[52] U.S. Cl. ..... 482/53; 482/148; 482/57

[58] Field of Search ..... 482/51, 52, 53, 57, 482/70, 148, 79, 80

[56] References Cited

U.S. PATENT DOCUMENTS

| | | | |
|---|---|---|---|
| 2,255,864 | 9/1941 | Stephens | 482/57 |
| 4,150,667 | 4/1979 | Takeuchi | 482/57 |
| 4,523,580 | 6/1985 | Tureaud | 128/52 |
| 4,682,771 | 7/1987 | Jean | 482/57 |

*Primary Examiner*—Stephen R. Crow

*Attorney, Agent, or Firm*—Morton J. Rosenberg; David I. Klein

[57] ABSTRACT

An improved pedal assembly is provided. The pedal assembly comprises a housing which can be readily attached to the supporting member of a stepping machine. A sliding plate is slidably received and moved reciprocally within a recess formed in the housing. The sliding plate is provided with a plurality of projecting rails. A pedal is disposed above the recess having a plurality of massaging members disposed in through opening formed in the pedal. A pair of covers are disposed above the pedal and can be pivotally displaced to expose the massaging members. An actuating means is interconnected to the sliding plate to reciprocally move the sliding plate as the pedal is displaced to simultaneously displace the massaging members to massage the soles of the user's feet.

3 Claims, 9 Drawing Sheets

PEDAL FOR SPORTING EQUIPMENT

BACKGROUND OF THE INVENTION

This invention relates to a pedal. More particularly, this invention relates to an improved pedal for sporting equipment which facilitates a stimulating effect to the sole of the user's foot to increase blood circulation during cycling. Additionally, no electrical power is required to be applied to the pedal for it to function.

In conventional sporting equipment, such as the small stepping machine disclosed in FIG. 1 and the large stepping machine disclosed in FIG. 2, no matter how complicated the structure of the machine, it incorporates a pedal 11 to support the user and facilitate the exercise. In fact, the pedal 11 is simply formed from molded plastic, and attached to the supporting rod 12 by means of screws. However, the conventional pedal 11 functions only to prevent the user's foot from sliding off.

Furthermore, the stepping machine just provides a periodic movement to the feet, no stimulation is provided to the sole of the user's feet. According to medical reports, the sole of each foot has a plurality of neural tissues. If the sole can be suitably and properly massaged, blood circulation can be improved and relaxation of the neural tissues can be readily achieved. On the other hand, pain in some parts of the body can be reduced and even cured by proper massage. In light of this, stimulating the soles of the user's feet during exercise can provide an excellent result to the user.

SUMMARY OF THE INVENTION

It is the object of this invention to provide an improved pedal which facilitates a stimulating effect to the sole of a user's foot to increase blood circulation during cycling. Further, no electrical power is required to be applied to the pedal for the pedal to function.

It is still another object of this invention to provide an improved pedal which has a soft upper portion made from a rubber material to ensure a soft and gentle contact with the user's sole and provide a mild massage thereto.

BRIEF DESCRIPTION OF THE DRAWINGS

The objects and other advantages of the present invention will become more apparent from the following detailed description when considered in connection with the accompanying drawings wherein.

DETAILED DESCRIPTION OF THE PREFERRED EMBODIMENT

Figure 1:
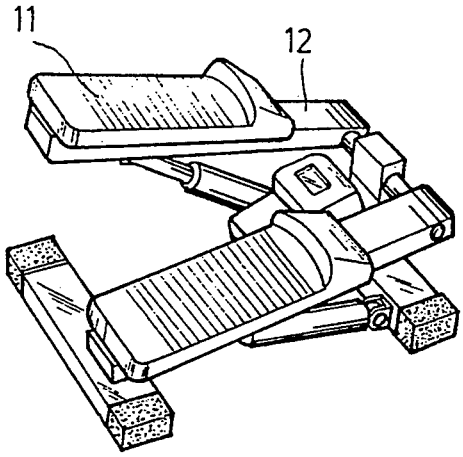
PRIOR ART FIG. 1
FIG. 1 is a perspective view of a small prior art stepper machine.
Figure 2:
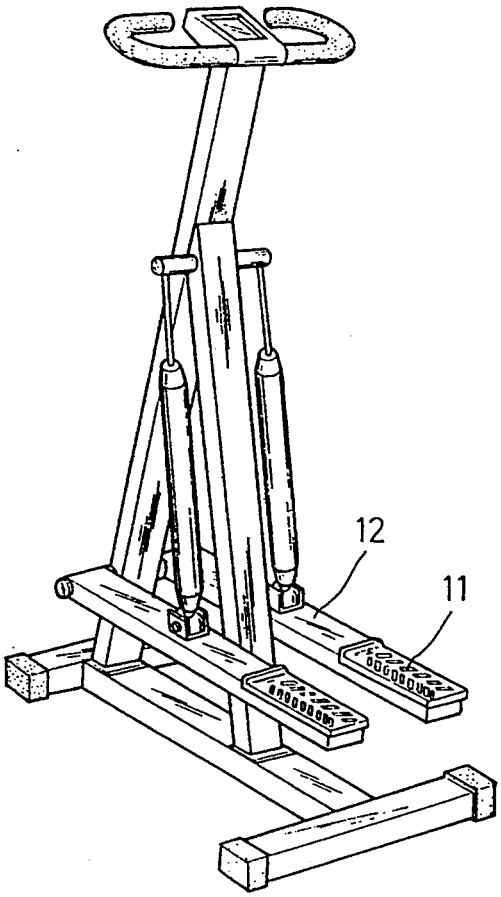
PRIOR ART FIG. 2
FIG. 2 is a perspective view of a large prior art stepper machine.
Figure 3:
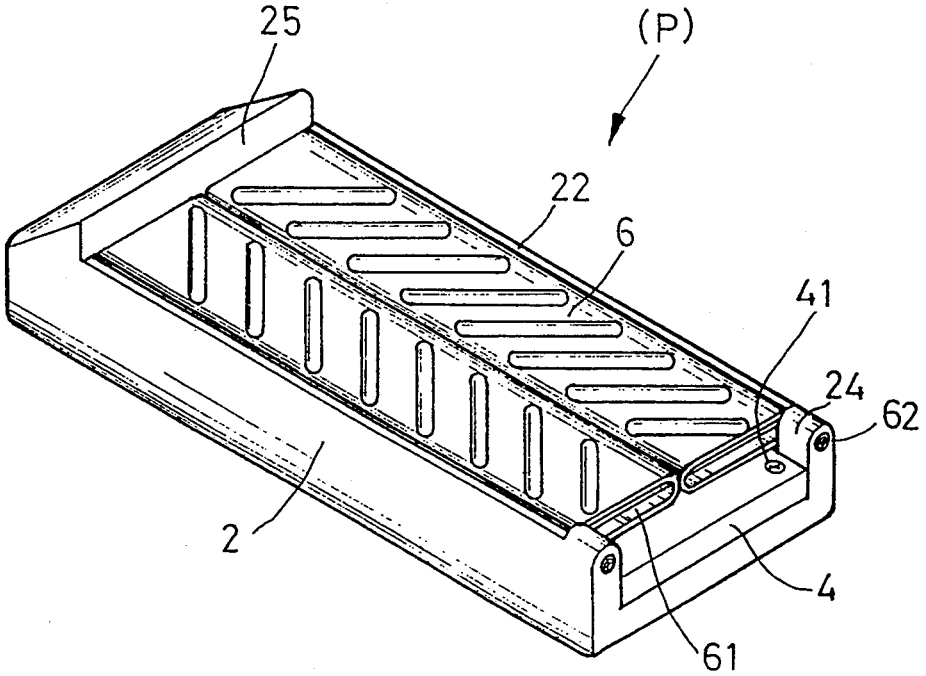
FIG. 3 is a perspective view of the pedal in a closed position.

Referring to FIGS. 3, 4, 5, 6 and 7, the pedal assembly P generally comprises a housing 2. The housing 2 is provided with a recess 21 having an elongate opening 211 formed therethrough. A receiving recess 23 is disposed between the outside portions of the slot 21 and the side plates 22. A pair of positioning bosses 24 are disposed on opposing sides adjacent the rear end of the receiving slot 23 of the housing 2.

A sliding plate 3 is capable of sliding reciprocally within the slot 21 of the housing 2. The bottom of the sliding plate 3 is provided with a pivoting lug 31. A plurality of projecting rails 32 are disposed on the top of the sliding plate 3. Each projecting rail 32 has an upper surface formed with an undulating surface contour.

A pedal 4 covers the slot 21 of the housing 2 and is fixed thereto by screw members 41. The upper surface of the pedal 4 is provided with a plurality of through holes 42. The bottom side of the pedal 4 is provided with a plurality of retaining slots 43, each slot 43 receiving a respective one of the projected rails 32 of the sliding plate 3. By this arrangement, the projected rails 32 can be slidably received within the retaining slots 43.

A plurality of massaging members 5 are disposed within the through holes 42 of the pedal 4. Each massaging member 5 can be projected above the pedal 4 by means of a respective projected rail 32 of the sliding plate 3. By this arrangement, the massaging members 5 can be lifted or lowered within the through hole 42.

A pair of covers 6 are each attached to the portion of housing 2 located between the front housing portion 25 and a respective positioning boss 24 on opposing sides of the housing 2, by means of the screws 62. Each cover 6 is provided with a positioning slot 61. The locking member 621 of each screw 62 is inserted into the positioning slot 61. By this arrangement, the cover 6 is attached to the housing 2. The bottom side of the cover 6 is provided with a space 63 for projection therein of massaging members 5.

An actuating means 7 is interconnected with the lug 31 of the sliding plate 3. Accordingly, the sliding plate 3 is moved reciprocally within the slot 21. As plate 3 is reciprocated, the massaging members 5 are alternately projected through the top surface of the pedal 4 and lowered therefrom. As a result, the soles of the user's feet are properly and softly massaged and stimulated.

Figure 12:
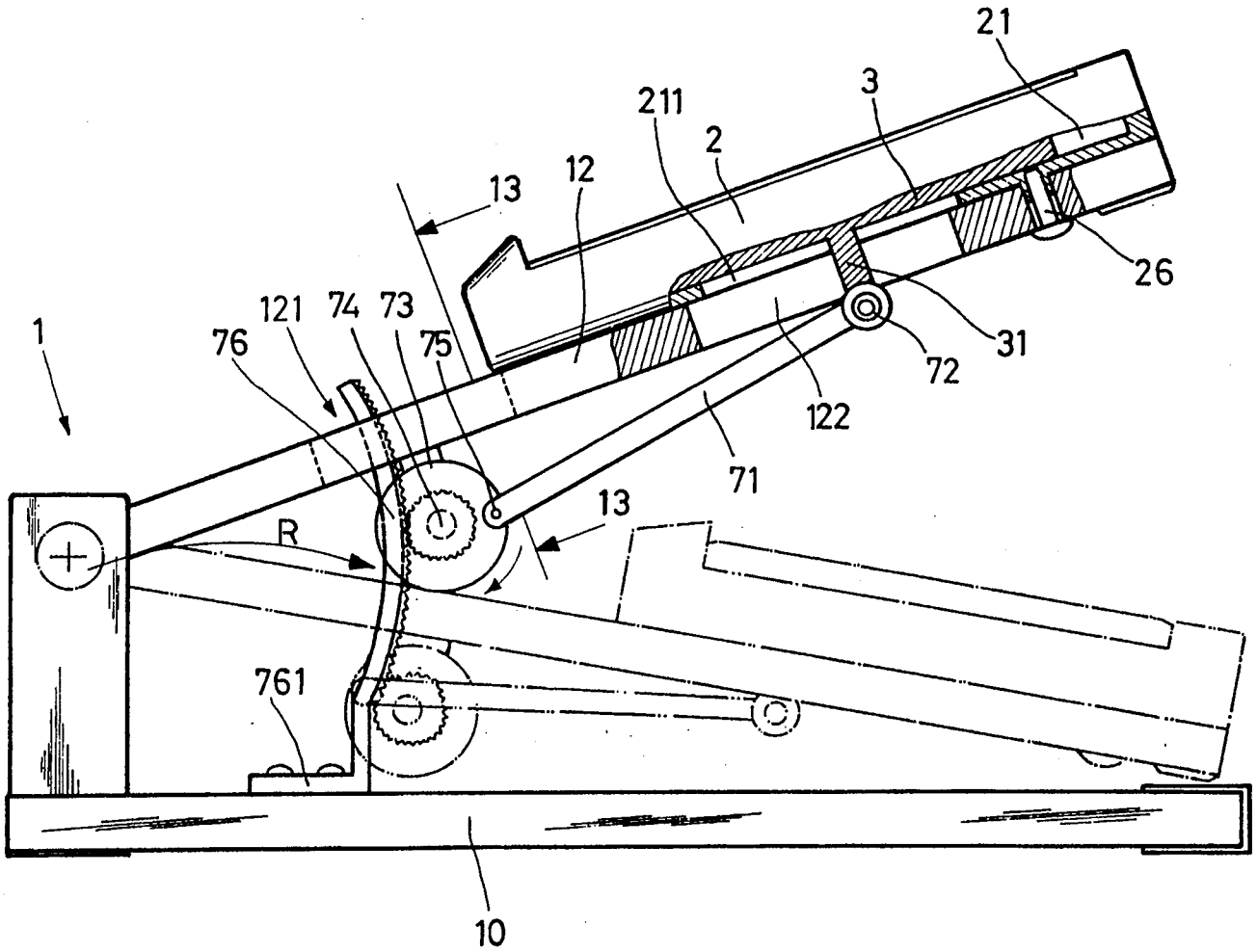
FIG. 12 is an elevation view, partially sectioned, showing the pedal being interconnected with an actuating means.
Figure 13:
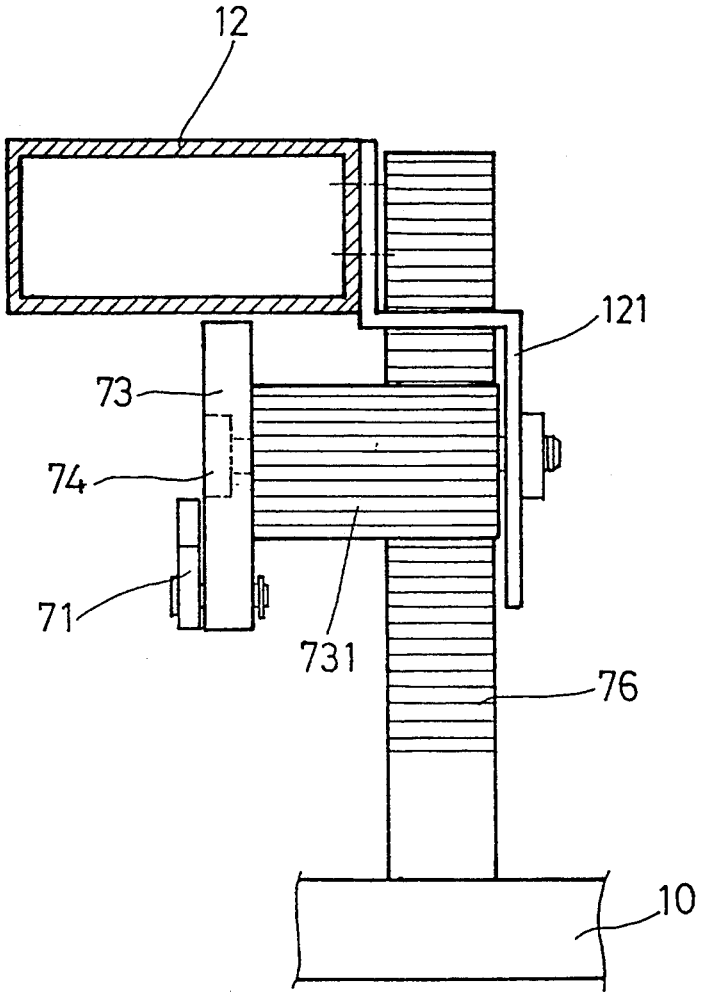
FIG. 13 is an elevation view of the actuating means in a certain position.
Figure 14:
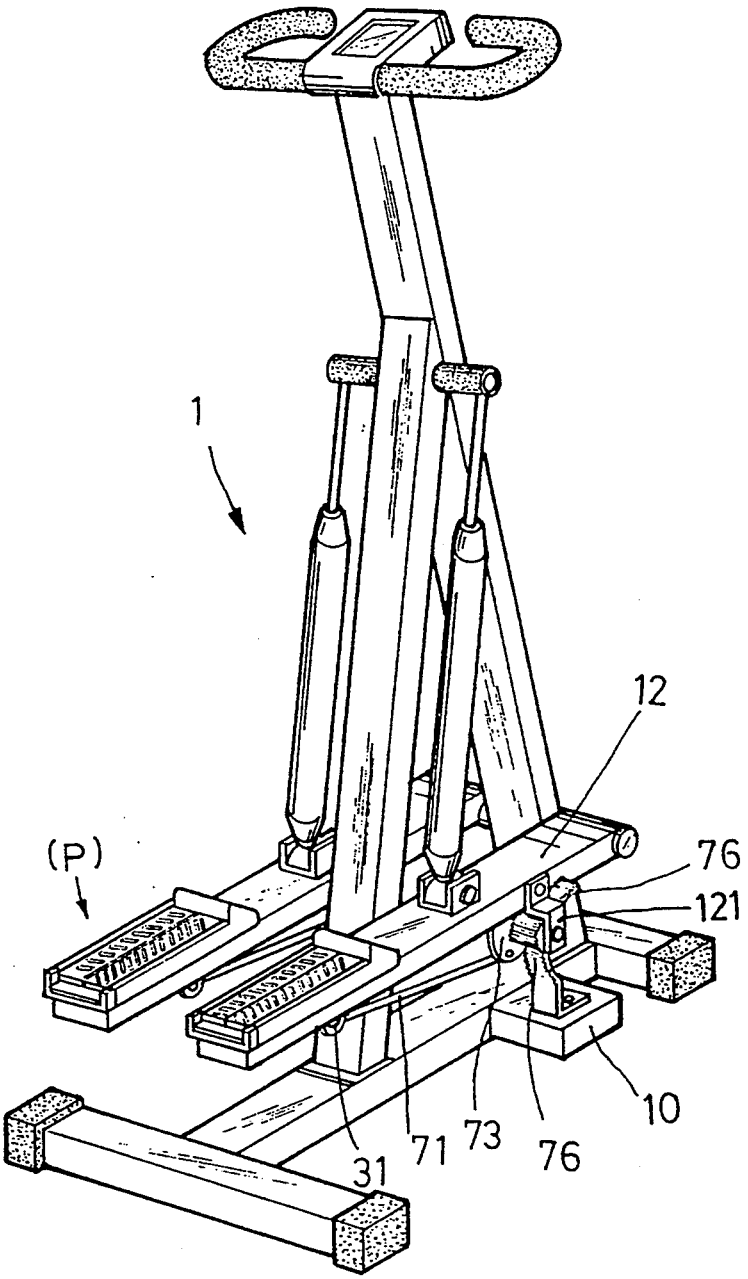
FIG. 14 is a perspective view of an exercise machine using the pedal assembly of the present invention.

Referring additionally to FIGS. 12, 13 and 14, the preferred embodiment of the actuating means 7 is shown to generally comprise an actuating rod 71 having a pivoting hole 731 at rear portion thereof. Accordingly, by utilization of a pivoting member or pin 72 and a C-clip 721, the actuating rod 71 is pivotedly interconnected to the lug 31 of the sliding plate 3.

An actuating wheel 73 which has a central hole 732 is rotatably supported on a shaft 74 attached to the folded plate 121. The inner side of the actuating wheel 73 is incorporated with teeth 731. The actuating wheel 73 has an eccentric configuration by its interconnection with the hole 712 of the actuating rod 71 by a pivot stud 75.

A rack 76 having a curved contour is meshed with the teeth 731 of the actuating wheel 73. The rack 76 has a mounting bracket 761 for attachment to the casing 10 of the exercise machine by means of screw members 762.

Referring further to FIGS. 12 and 13, the pedal assembly P is attached to the supporting rod 12 of the stepping machine 1. When the pedal assembly P is reciprocated by the user, the actuating wheel 73 which is supported from the shaft 12 by the side plate 121, is rotated up and down along the curvature R of the teeth of rack 76. While the actuating wheel 73 is rotating, the actuating rod 71 is moved reciprocally. As a result, the lug 31 of the sliding plate 3 is moved reciprocally within the elongated slotted opening 211 and the slotted opening 122 of the supporting shaft 12. Consequently, the sliding plate 3 is moved reciprocally within the slot 21 of the housing 2. Accordingly, the soles of the user's feet are periodically and properly massaged.

Figure 8:
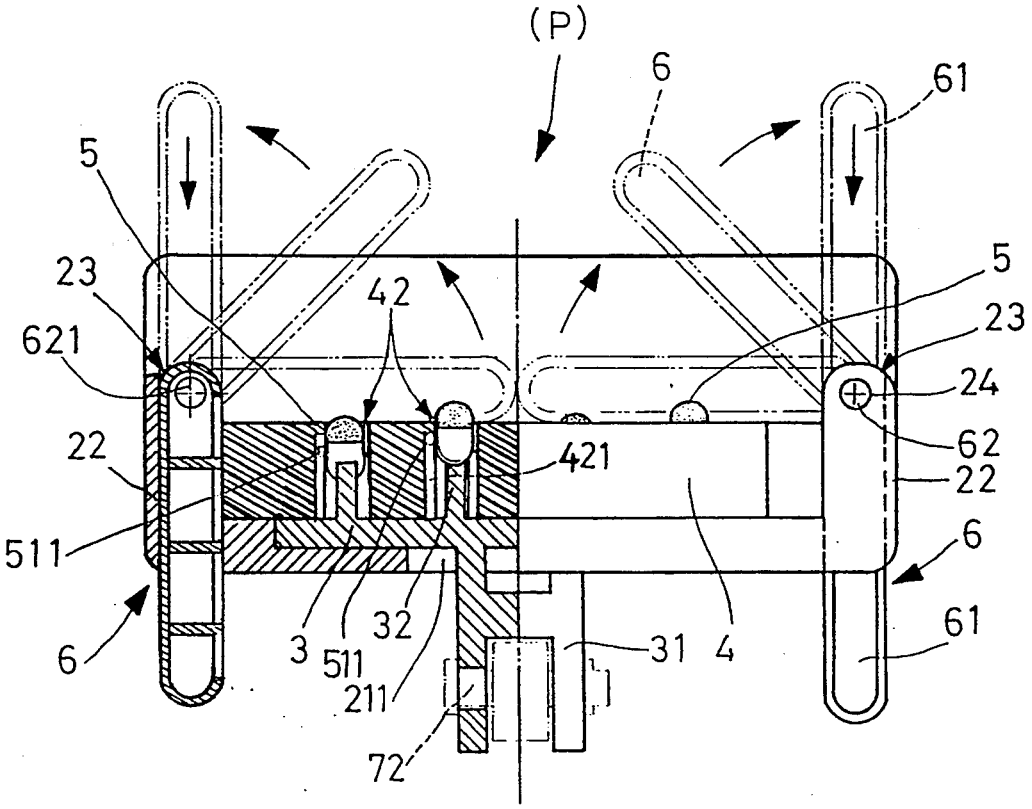
FIG. 8 is an end view, partially sectioned, showing the pedal assembly is fully extended.

Referring now to FIG. 8, if the user hopes to get his/her sole massaged, the cover 6 can be lifted to an open position. As clearly shown in FIG. 5, the positioning slot 61 of the cover 6 is supported by the locking members 621 of the screws 62. The cover 6 can be lifted from and readily disposed within the receiving slot 23.

Figure 10:
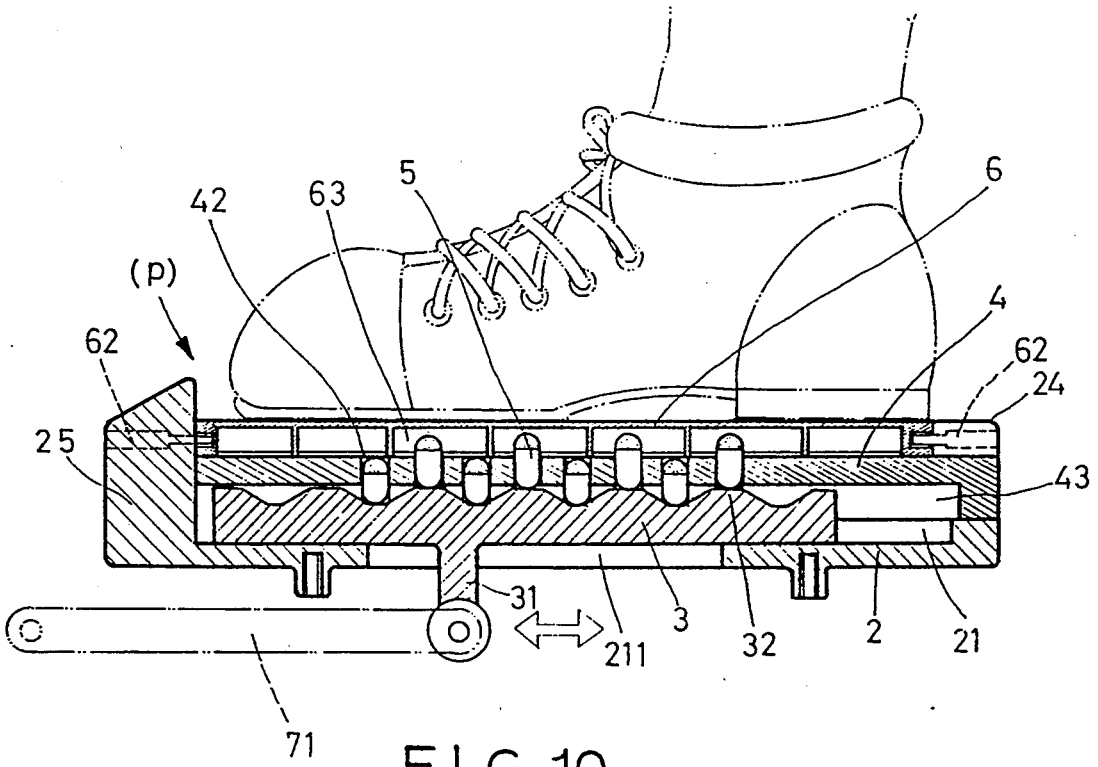
FIG. 10 is a longitudinally sectioned view of the pedal functions as a simple pedal.
Figure 11:
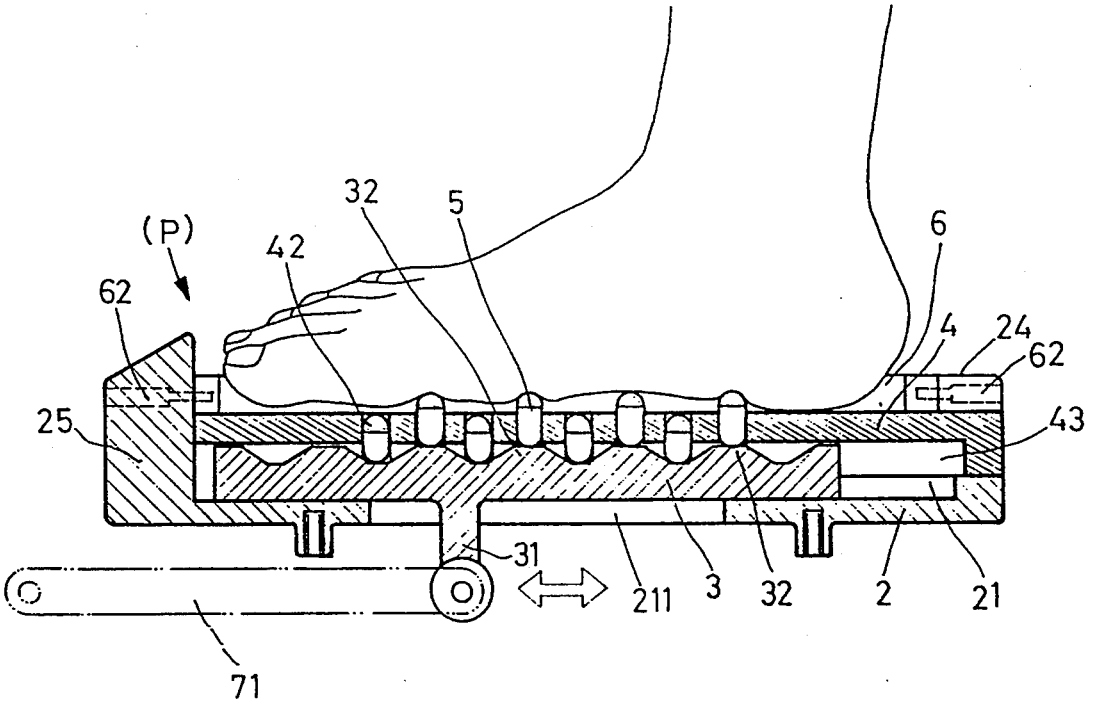
FIG. 11 is a longitudinally sectioned view showing the pedal is in use.

Referring now to FIGS. 10 and 11, the pedal assembly P is shown in use. In FIG. 10, the cover 6 is shown folded, the pedal assembly P can then be used as a normal pedal. There is no need for the user to take off his/her shoes, the user can step directly on the covers. In this situation, the sliding plate 3 is moved by the actuating rod 71 and the massaging members 5 can project periodically above the pedal 4. However, the massaging members 5 are confined within the spaces 63 of the covers 6, and will not interfere with the stepping movement of the user.

Figure 4:
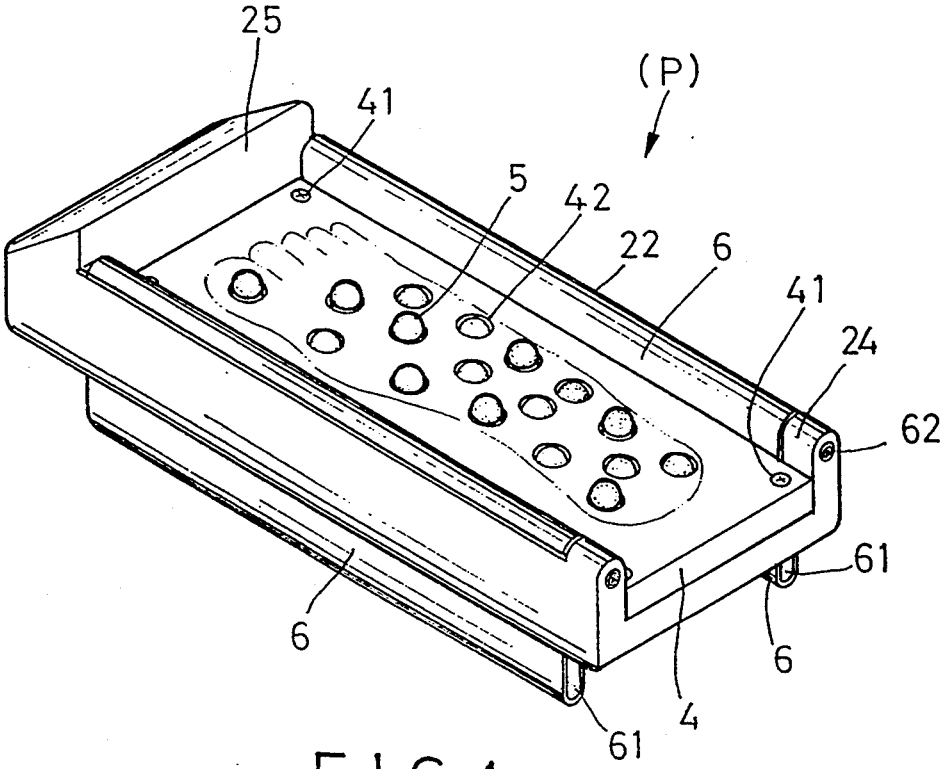
FIG. 4 is a perspective view of the pedal in an open position.
Figure 5:
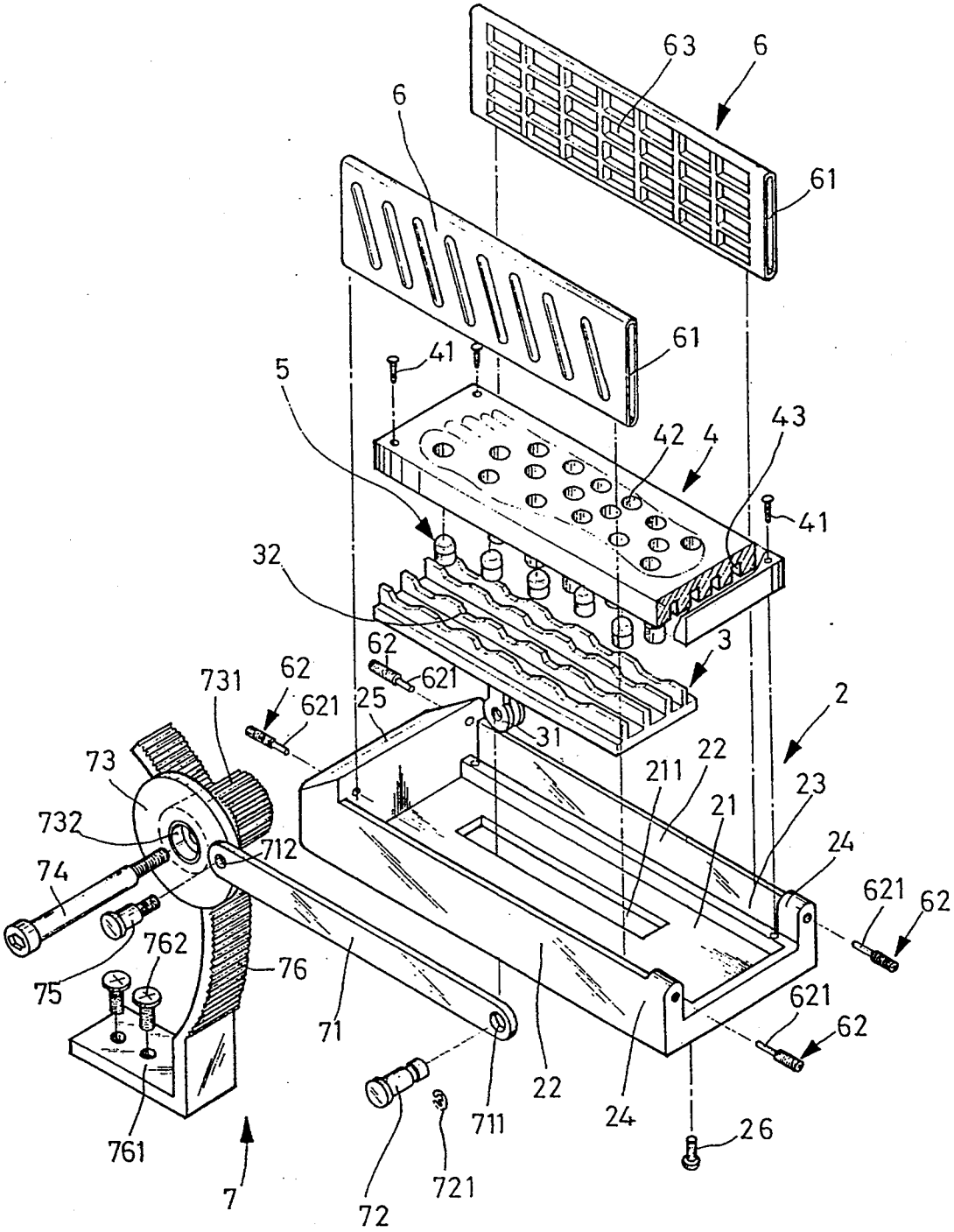
FIG. 5 is an exploded perspective view of the pedal made according to this invention.
Figure 6:
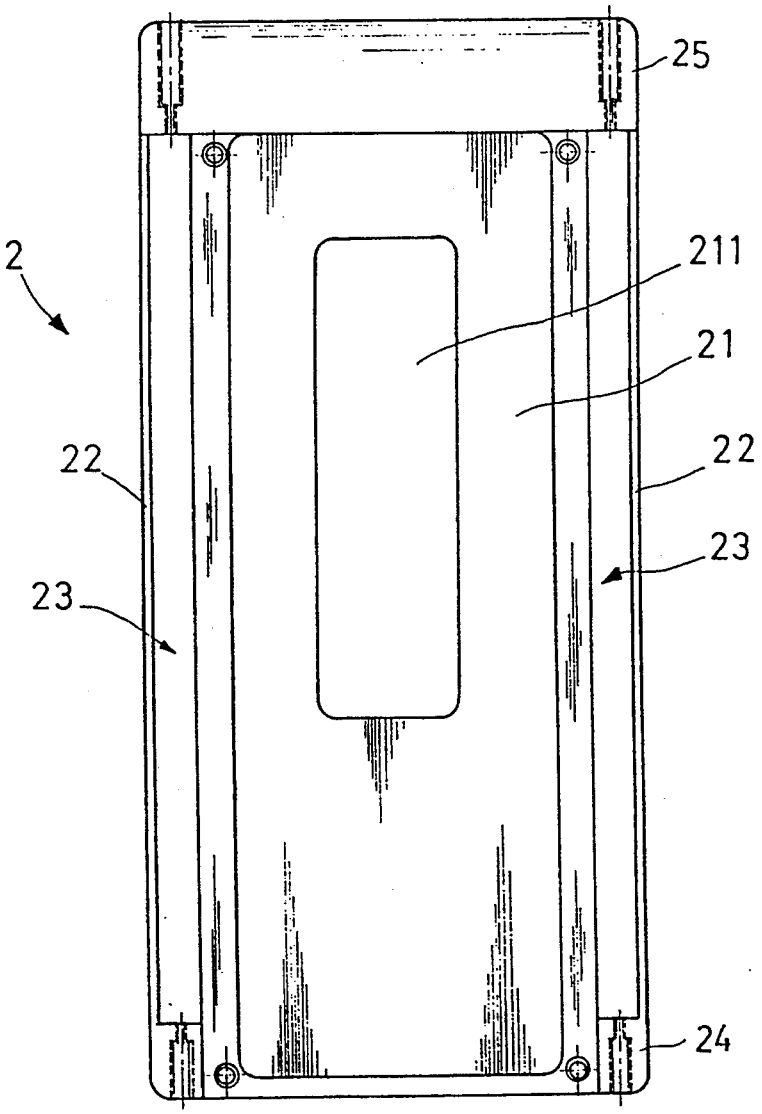
FIG. 6 is a top view of the housing of the pedal assembly.
Figure 7:
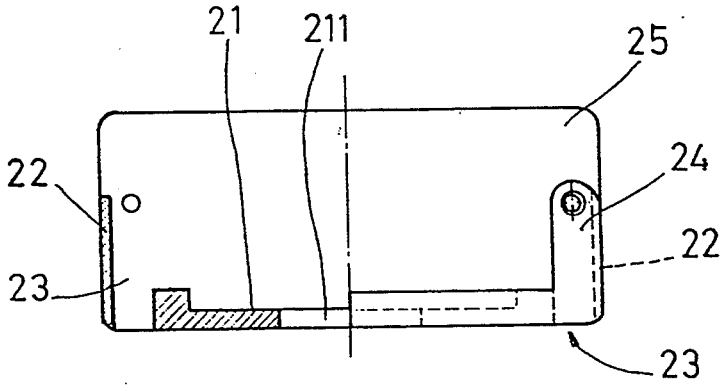
FIG. 7 is a cross-sectional view of the housing of the pedal assembly.

Referring to FIG. 11, the cover 6 is shown lifted and opened on opposing sides of housing 2, as clearly shown in FIGS. 4 and 8. In this case, the user takes off his/her shoes and the sole of each foot will rest directly on a pedal 4. When the stepping movement is commenced, the sliding plate 3 is moved reciprocally within the slot 21 by virtue of the actuating rod 71. Responsive to the reciprocating movement of plate 3, the projecting rails 32 will alternately lift and lower the massaging members 5. By this arrangement, the massaging members 5 are lifted and lowered within the through holes 42 of the pedal 4. As a result, the sole of each foot is properly and softly massaged and stimulated. Thus, a massaging effect is readily achieved during the stepping movement.

Figure 9:
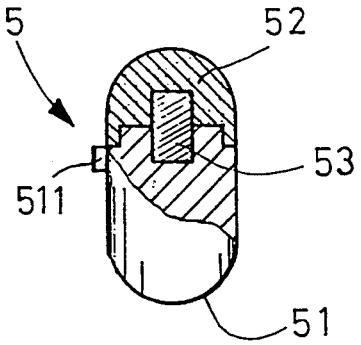
FIG. 9 is a cross-sectional view of the massaging member made according to this invention.

Referring to FIG. 9, there is shown, the massaging member 5 having a post configuration with an arcuate bottom surface to facilitate displacement by the projecting rails 32. The massaging member 5 is made from a hardened plastic material or other suitable rigid material. By this arrangement, the massaging member 5 will not be deformed during the camming action performed by the projecting rails 32. The massaging member 5 also includes a soft rubber upper end 52 which has a thumb-like configuration to provide a soft contact with the sole of the user's foot. If the massaging member 5 were made totally from soft rubber, the massaging member 5 would be easily deformed and the massaging effect would thereby be impaired. By forming the massaging member 5 from a composite structure, that is, a soft upper portion and a rigid lower portion, an excellent effect can be achieved.

Additionally, a magnet member 53 is disposed within the soft rubber upper end 52. As a result, an enhanced effect can be readily achieved since the magnetic field will provide a further improved effect to the blood circulation. Referring further to FIGS. 8 and 9, each through hole 42 of the pedal 4 is provided with a retaining slot 421. Each massaging member 5 includes a positioning boss 511 which is moved and guided within the retaining slot 421. By this arrangement, the massaging members 5 are retained within the through holes 42 of the pedal 4.

In FIG. 14, an exercise machine using the pedal assembly P of the instant invention is shown. The pedal assembly P is affixed to the supporting shaft 12 of the stepping machine 1. The actuating means 7 is installed to the stepping machine 1 in a suitable position, as shown and disclosed relative to FIGS. 12 and 13. There are modifications to existing exercise machine that can be made. The actuating rod 71 of the actuating means 7 must be of a suitable length to meet the actual requirements of the machine. The rack 76 is attached to the casing 10 in a suitable position. The stepping machine 1, shown in FIG. 14, is a typical stepping machine structure. There are a plurality of stepping machine types, such as hydraulic, spring or electrically actuated types. However, the pedal assembly P can be readily incorporated to such a stepping machine 1 easily and conveniently. When the covers 6 are in a closed position, the pedal assembly P serves as a normal pedal, and can be readily lifted to serve as a pedal with a massaging effect.

The pedal assembly P as disclosed, has the following advantages:

1. The up and down movement of the massaging members 5 within the respective through holes 42 of the pedal 4 is responsive to the reciprocating displacement of projecting rails 32 of the sliding plate 3. Accordingly, no electrical power or motor is used to reciprocate the sliding plate 3.
2. The pedal assembly P can function as a conventional pedal or a pedal having massaging function. Thus, the pedal assembly P provides a pedal which is multi-functional.
3. The pedal assembly P has a simple configuration which can be installed on various stepping machines of different configurations.

Although the present invention has been described in connection with a preferred embodiment, many other variations and modifications will now become apparent to those skilled in the art, all without departing from the scope of the invention. Therefore, the present invention should not be limited by the specific disclosure herein, but only by the appended claims.

I claim:

1. An improved massaging pedal assembly for sporting equipment, comprising:

a housing having a recess with an elongated slotted through opening formed therein, a receiving recess disposed between outside portions of the recess and a pair of side plates disposed on opposing sides of said housing, a positioning boss being disposed at a rear end of the receiving recess of the housing;

a sliding plate capable of sliding reciprocally within the recess of the housing, the bottom of the sliding plate being provided with a pivoting lug extending through the slotted opening, a plurality of projecting rails being disposed at the top of the sliding plate;

a pedal covering the recess of the housing and being affixed thereto by screw members, the upper surface of the pedal being provided with a plurality of through holes, the bottom side of the pedal being provided with a plurality of retaining slots for respective receipt of the plurality of projecting rails of the sliding plate, the projecting rails being slidably received by the retaining slots a plurality of massaging members disposed within the through holes of the pedal, each massaging member being capable of being projected above the pedal responsive to reciprocal displacement of the projecting rails of the sliding plate, each massaging member being lifted or lowered within a respective through hole; and a pair of covers attached to a portion of the housing located between a front portion thereof and a respective positioning boss of the housing by screws, each of the covers being provided with a positioning slot, a locking member of each of the screws being inserted into the positioning slot, the bottom side of the cover being provided with a space for projection of the massaging members therein.

2. An improved pedal as recited in claim 1, wherein said actuating means generally comprises an actuating rod having a pivoting hole at a rear portion thereof, the actuating rod being pivotedly interconnected to the lug of the sliding plate; an actuating wheel having a central hole is rotatably supported by a shaft attached to a folded plate, an inner side of the actuating wheel is provided with gear teeth, the actuating wheel is eccentrically interconnected with one end of the actuating rod by a pivot stud; a rack which has an arcuate contour is meshed with the gear teeth of the actuating wheel, the rack being attached to a machine casing by means of screw members.

3. An improved pedal assembly as recited in claim 1, wherein said massaging member includes a soft upper portion and a rigid lower portion.

* * * * *